US011505970B2

(12) United States Patent
Savant et al.

(10) Patent No.: US 11,505,970 B2
(45) Date of Patent: Nov. 22, 2022

(54) DOOR LEAF HANDLE FOR A MOTOR VEHICLE

(71) Applicant: U-Shin Italia S.p.A., Pianezza (IT)

(72) Inventors: Marco Savant, Pianezza (IT); Antonino Cannavo, Pianezza (IT); Anthony Guerin, Pianezza (IT); Simone Ilardo, Pianezza (IT)

(73) Assignee: U-Shin Italia S.p.A., Pianezza (IT)

( * ) Notice: Subject to any disclaimer, the term of this patent is extended or adjusted under 35 U.S.C. 154(b) by 73 days.

(21) Appl. No.: 17/111,672

(22) Filed: Dec. 4, 2020

(65) Prior Publication Data

US 2021/0172207 A1 Jun. 10, 2021

(30) Foreign Application Priority Data

Dec. 4, 2019 (EP) ..... 19213665

(51) Int. Cl.
*E05B 77/02* (2014.01)
*E05B 79/20* (2014.01)
(Continued)

(52) U.S. Cl.
CPC ..... *E05B 77/02* (2013.01); *E05B 79/20* (2013.01); *E05B 81/04* (2013.01); *E05B 85/16* (2013.01)

(58) Field of Classification Search
CPC ..... E05B 77/02; E05B 79/10; E05B 79/12; E05B 79/20; E05B 81/04; E05B 81/14;
(Continued)

(56) References Cited

U.S. PATENT DOCUMENTS

2011/0101709 A1 5/2011 Katsumata et al.
2011/0290577 A1 12/2011 Abidi
(Continued)

FOREIGN PATENT DOCUMENTS

EP 3556975 A1 * 10/2019 ..... B60J 5/0468
WO WO-2012034665 A1 * 3/2012 ..... E05B 77/06
(Continued)

OTHER PUBLICATIONS

European Search Report for Corresponding EP Application No. 19213665, dated Jun. 3, 2020.

*Primary Examiner* — Christine M Mills
*Assistant Examiner* — Christopher F Callahan
(74) *Attorney, Agent, or Firm* — Burris Law, PLLC

(57) ABSTRACT

A door leaf handle for a motor vehicle and an assembly including the handle includes a bracket and a gripping element is movable relative thereto between a rest position, a primary door opening position and a secondary door opening position. At least one breakable stop limits displacement of the gripping element in the primary door opening position if pulling force applied is less than a predetermined force value and configured to break if a pulling force applied on the gripping element exceeds the predetermined value and to allow the displacement of the gripping element beyond the primary door opening position to the secondary door opening position. A primary door opening trigger is activated by displacement of the gripping element in the primary door opening position. A secondary mechanical door opening trigger is activated by displacement of the gripping element in the secondary door opening position.

14 Claims, 6 Drawing Sheets

(51) Int. Cl.
*E05B 81/04* (2014.01)
*E05B 85/16* (2014.01)

(58) Field of Classification Search
CPC ..... E05B 81/90; E05B 81/64; E05B 81/76; E05B 85/10; E05B 85/14; E05B 85/16; E05B 85/18; E05B 85/103; E05B 17/0054; E05B 17/0062; E05B 17/0066; E05B 5/00; Y10T 292/57; Y10S 292/38
See application file for complete search history.

(56) References Cited

U.S. PATENT DOCUMENTS

| | | | |
|---|---|---|---|
| 2016/0053516 | A1 | 2/2016 | Schoch et al. |
| 2018/0195319 | A1 | 7/2018 | Cousin et al. |

FOREIGN PATENT DOCUMENTS

| | | | | |
|---|---|---|---|---|
| WO | WO-2017148475 A1 * | 9/2017 | ..... | E05B 79/20 |
| WO | 2021083523 | 5/2021 | | |

* cited by examiner

DOOR LEAF HANDLE FOR A MOTOR VEHICLE

CROSS-REFERENCE TO RELATED APPLICATIONS

This application claims priority to and the benefit of EP 19213665.3, filed on Dec. 4, 2019. The disclosures of the above application are incorporated herein by reference.

FIELD

The present disclosure relates to a door leaf handle for a motor vehicle.

BACKGROUND

The statements in this section merely provide background information related to the present disclosure and may not constitute prior art.

Door leaf handles conventionally include a bracket configured to be fixed on the door and a gripping element connected to the bracket by a hinge.

The gripping element is movable in rotation or in translation relative to the bracket between a flush position in which it is substantially parallel to the bracket and recessed in the door, and a rest position in which it is inclined relative to the support. The gripping element can also be directly in the rest position.

Door leaf handles can also include a device for activating the opening of the door leaf.

Such a handle is connected to a latch present on the door of the motor vehicle by a mechanical link, for example by a cable called a Bowden cable or electrically. In case of a typical electrical handle, when a user wishes to open the door of the motor vehicle, the user activates an actuator which sends an electrical opening signal to open the door. This type of electrical link between the handle and the latch can have a drawback. For example, in a situation where strong contact with another vehicle occurs when the gripping element is in the rest position, the acceleration undergone during such an accident may cause the vehicle door to be blocked. Thereby, rescuers like fireman or policeman may not be able to open the door to have access to the interior of the vehicle and therefore assist a person inside because the electrical system of the vehicle is down.

The door leaf handle of the present disclosure overcomes these and other disadvantages associated with typical door leaf handles.

SUMMARY

This section provides a general summary of the disclosure and is not a comprehensive disclosure of its full scope or all of its features.

In one form, a door leaf handle for a motor vehicle includes a gripping element and a bracket. The gripping element is configured to be movable relative to the bracket between a rest position, a primary door opening position and a secondary door opening position. The door leaf handle includes at least one breakable stop configured to limit the displacement of the gripping element in the primary door opening position if a pulling force applied on the gripping element is less than a predetermined force value. The door leaf handle includes a primary door opening trigger configured to be activated by the displacement of the gripping element in the primary door opening position. The at least one breakable stop is configured to break if a pulling force applied on the gripping element exceeds the predetermined force value and to allow the mechanical displacement of the gripping element beyond the primary door opening position to the secondary door opening position. The door leaf handle includes a secondary mechanical door opening trigger configured to be activated by the displacement of the gripping element in the secondary door opening position.

As used herein, the word "breakable" means that it can be broken, destroyed.

In case of emergency, and if the primary door opening position does not allow the door leaf opening, a person located at the exterior of the vehicle can still open the door leaf. This is in contrast to typical handles which cannot be displaced further than the primary door opening position because of the predetermined stroke of the gripping element allowed by the bracket.

The at least one breakable stop allows, when it is broken, to reach more stroke to open the door leaf.

According to one form, the primary door opening mechanism is an electrical mechanism activated by an actuator configured to send an electrical door leaf opening signal.

In case of emergency and if the electrical mechanism is down, the door leaf can still be opened.

According to another form, the at least one breakable stop is a part of the gripping element and particularly, the gripping element includes an exterior area turned toward the vehicle exterior and an interior area turned toward the vehicle interior. The at least one breakable stop is arranged on the interior area of the gripping element and against the bracket.

By this way, the force exerted on the gripping element allows for breaking the at least one breakable stop because of the pressure exerted by the bracket on the at least one breakable stop.

According to yet another form, the gripping element is movable in rotation relative to the bracket according to a rotation axis of the gripping element perpendicular to the gripping element deployment, the at least one breakable stop extending radially to the bracket.

According to still another form, the at least one breakable stop is integral with the gripping element.

According to another form, the at least one breakable stop is inserted or overmolded with the gripping element.

According to still another form, the at least one fusible area is wrapped with a seal.

The seal wrapping the at least one breakable stop allows for reducing the friction during the normal working of the handle.

According to yet another form, the at least one breakable stop includes a breakable area and a non-breakable area, the breakable area and the non-breakable area being delimited by a breaking point configured to separate the breakable area from the non-breakable area when a predetermined force is exerted on the gripping element.

The breaking point formed on the at least one breakable stop allows to facilitate the breaking of this at least one breakable stop.

According to still another form, the gripping element includes two breakable stops.

If the gripping element includes more breakable stops, this can assure the voluntary door leaf opening.

According to yet another form, the at least one breakable stop is a plastic or metal material.

According to still another form, the handle is a flush handle, in particular a flush door handle.

Indeed, some vehicles are equipped with a handle recessed in their door. These handles allow obtaining an improved aesthetic effect because they merge with the rest of the door, and are therefore discrete in the flush position. This type of handle also allows improving the aerodynamics of the vehicle when it is moving, thanks to its flush position relative to the vehicle door. These recessed handles are available in mechanical versions and motorized versions.

According to yet another form, the rest position is obtained electrically from a flush position of the gripping element, relative to the door leaf, by the actuation of an actuator configured to send an electrical signal of gripping element deployment.

The present disclosure also concerns an assembly including a handle including any one of the characteristics presented above, a latch, a primary door opening mechanism coupled with the primary door opening trigger and a secondary door opening mechanism coupled with the secondary door opening trigger.

According to a characteristic, the secondary door opening mechanism includes a Bowden cable or a rod.

According to another characteristic, the secondary door opening mechanism is configured to generate a displacement of the Bowden cable or the rod, a value of the displacement being a multiple of a gripping element displacement.

According to yet another characteristic, the secondary door opening mechanism includes a lever including a pulley, the Bowden cable or the rod being configured to wrap around the pulley.

According to yet another characteristic, the Bowden cable or the rod includes a first extremity connected to a first fixed part and a second extremity connected to the latch.

According to yet another characteristic, a pin attached to the gripping element is configured to drive the lever from an inactive position to an active position, the driving being performed when the gripping element is moved from the primary door opening position to the secondary door opening position.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 5 is a partial schematic sectional view from above of a handle of a third construction according to the teachings of the present disclosure; and.

Figure 1:
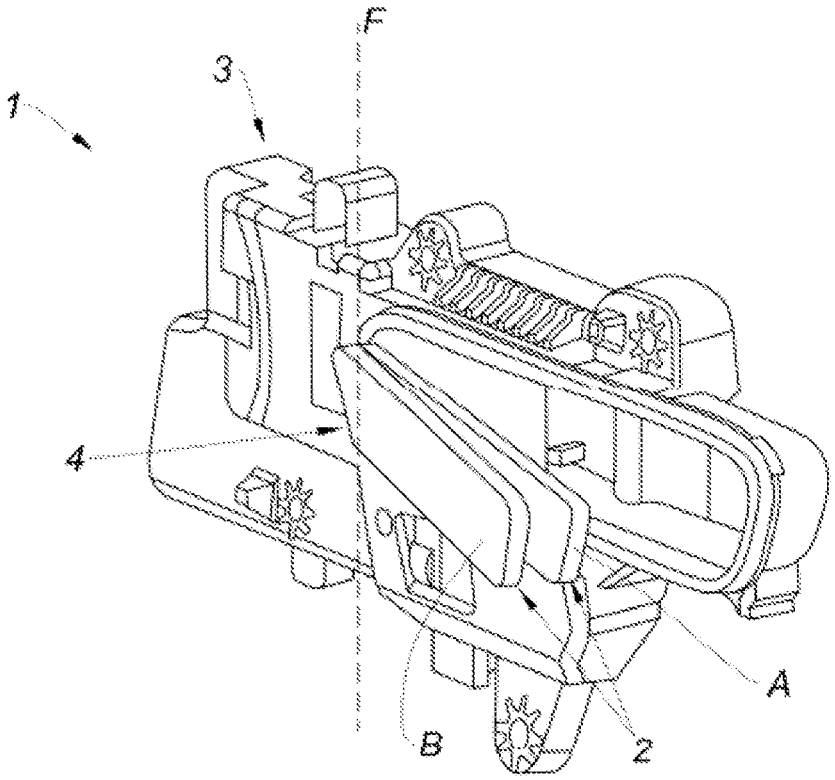
FIG. 1 is a perspective view of a handle, in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a door leaf handle 1 for a motor vehicle with a gripping element 2 in two different positions is illustrated. The rest position is not represented. The positions illustrated are the primary door opening position A and the secondary door opening position B.

If the door leaf handle 1 is a flush handle, then the door leaf handle 1 moves relative to the bracket 3 from the flush position to the secondary door opening position B, by passing through the primary door opening position A. In this manner, the gripping element 2 moves away from the bracket 3 and therefore away from the door leaf (not represented).

The gripping element 2 is configured to deploy from the bracket 3 according to a rotational movement.

It should be noted that translationally extracting the gripping element 2 is also possible.

Figure 2:
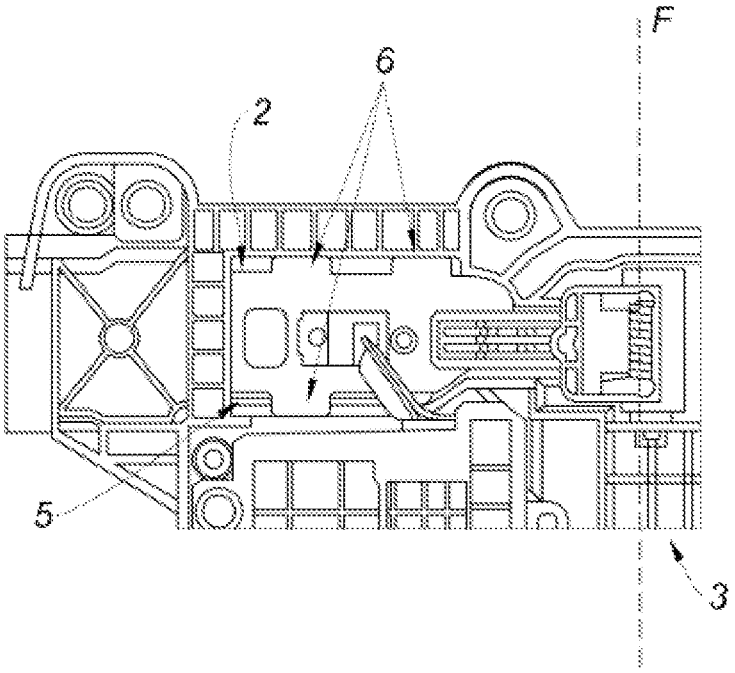
FIG. 2 is a rear view of the handle of FIG. 1.

The solution allowing a bigger stroke of the gripping element 2, corresponding to the displacement of the gripping element 2 from the primary door opening position A to the secondary door opening position B will be presented referring to FIG. 2.

FIG. 2 shows an interior area 5 of the gripping element 2 inserted into the bracket 3.

In the example provided, the interior area 5 of the gripping element 2 includes three breakable stops 6.

Each of these breakable stops 6 extends radially, perpendicularly to the rotation axis F of the gripping element 2, allowing the extraction of the gripping element 2.

Each and only these breakable stops 6 are in contact against the bracket 3. In other words, the bracket 3 is a stop for the gripping element 2 by the breakable stops 6. By this arrangement, the gripping element 2 cannot move from the primary door opening position A to the secondary door opening position B due to the breakable stops if a pulling force applied on the gripping element 2 is less than a predetermined force value.

Figure 3:
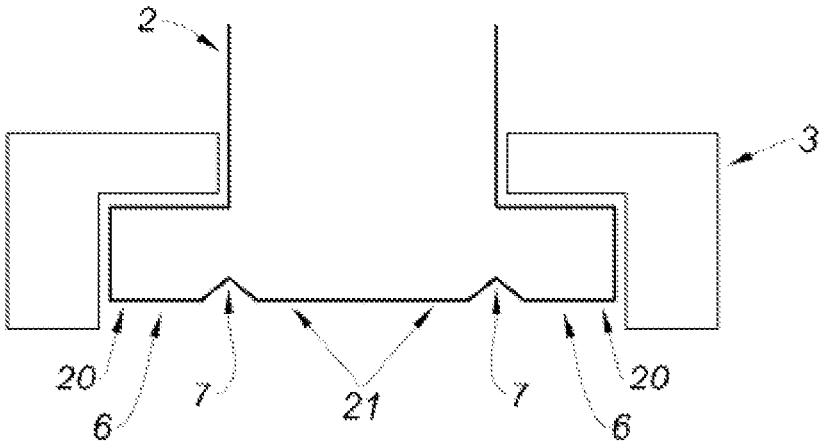
FIG. 3 is a partial schematic sectional view from above of a handle of a first construction according to the teachings of the present disclosure.

FIG. 3 shows schematically the gripping element 2 inserted into the bracket 3.

Two breakable stops 6 are shown in stop with the bracket 3, preventing a bigger stroke than the displacement of the gripping element 2 from the rest position to the primary door opening position A.

In this configuration, a breaking point 7, for example a notch, is formed on each breakable stop 6. The breaking point 7 is arranged at the limit between the bracket 3 and the gripping element 2, determining a breakable area 20 and a non-breakable area 21 of the breakable stop 6.

The breakable area 20 of the breakable stop 6 is configured to break when a predetermined force is exerted on the gripping element 2 and more particularly when a pulling force is exerted on the gripping element 2, allowing a bigger stroke of the gripping element 2.

Indeed, each breakable area 20 is in stop against the bracket 3. The part of the bracket 3 in stop with the breakable area 20 and allowing the breaking of the breakable area 20, is disposed next to the breakable area 20.

In this configuration, each breakable stop 6 is integral with the gripping element 2 and is formed in plastic material.

Figure 4:
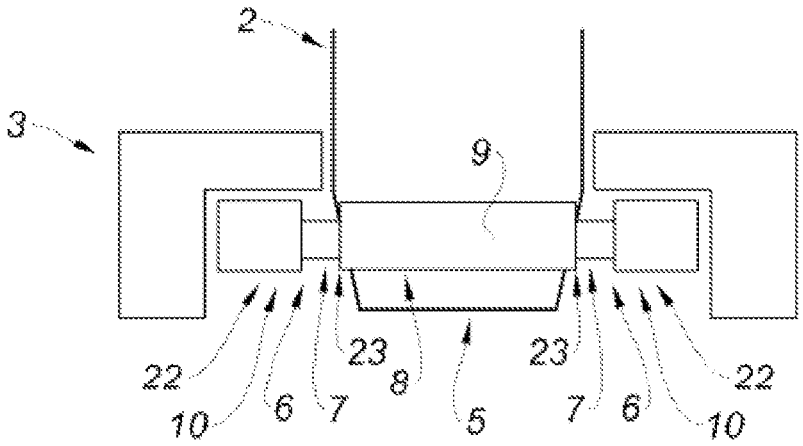
FIG. 4 is a partial schematic sectional view from above of a handle of a second construction according to the teachings of the present disclosure.

FIG. 4 shows the gripping element 2 inserted into the bracket 3 according to another configuration.

In this other configuration, a shaft or a plate 8 is inserted or overmolded to the interior area 5 of the gripping element 2. The plate 8 includes a principal part 9 extending over the extension length of the gripping element 2. Two arms 10 extends from the principal part 9 beyond the extension length of the gripping element 2 and are in stop with the bracket 3.

A reduction of the width, corresponding to the breaking point 7, of each of the arms 10 is arranged at the limit between the bracket 3 and the gripping element 2, determining a breakable area 22 and a non-breakable area 23 of the breakable stop 6.

In this configuration, the plate 8 and the arms 10 are formed in metallic material.

This metallic material confers different behavior compared to the plastic material used in the preceding configuration seen in FIG. 3, in case of high temperature or humidity.

Moreover, the metallic material offers more security concerning the pulling force, corresponding of an amount of Newton, needed to move the gripping element 2 from the primary door opening position A to the secondary door opening position B.

Figure 5:
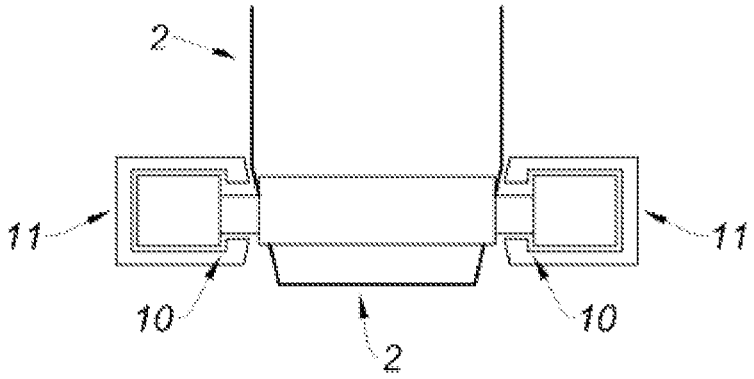

FIG. 5 shows yet another configuration of the breakable stop 6.

In contrast with the preceding configuration, a seal 11 surrounds each arm 10 as shown in FIG. 5. The seals 11 are arranged between the arms 10 and the bracket 3 thereby reducing the friction during the normal working of the handle 1.

Figure 6:
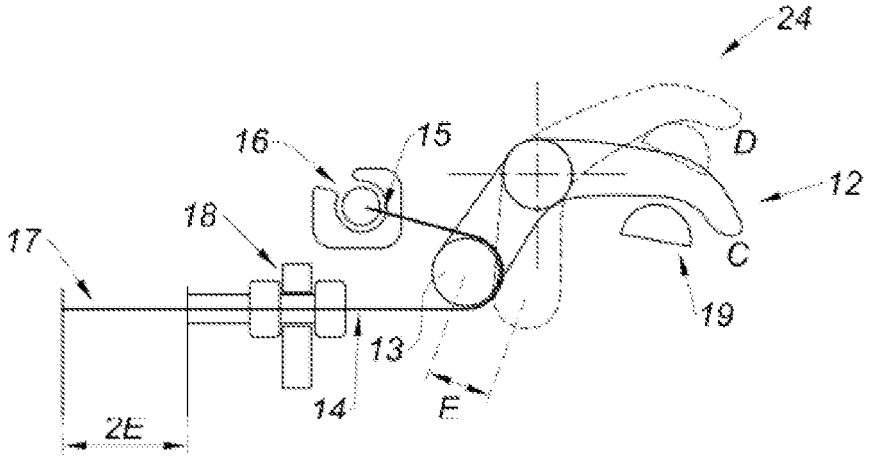
FIG. 6 is a partial schematic view of a secondary door opening mechanism allowing a bigger stroke of the gripping element of a handle, according to the teachings of the present disclosure.

FIG. 6 shows the secondary door opening mechanism 24 allowing to trigger the door leaf opening when a user pulls on the gripping element 2 to reach the secondary door opening position B of the gripping element 2. The secondary door opening mechanism 24 includes a lever 12 including itself a pulley 13.

A Bowden cable 14 includes a first extremity 15 connected to a first fixed part 16 and a second extremity 17 connected to a latch (not represented), the second extremity 17 passing through a second fixed part 18 is configured to wrap around the pulley 13.

Each first and second fixed part 16 and 18 are attached to the gripping element 2, and especially to the interior area 5 of the gripping element 2.

A pin 19, also attached to the gripping element 2 is configured to drive the lever 12 from an inactive position C corresponding to the rest or primary door opening position A of the gripping element 2 to an active position D corresponding to the secondary door opening position B of the gripping element 2.

The operation of the door leaf handle 1 is described below.

If the door leaf handle 1 is a flush handle, in normal working of the handle 1, to deploy the gripping element 2 from the flush position relative to the bracket 3 to the rest position, the user actives an actuator, such as a switch or a sensor, arranged on the handle 1 and specifically on the exterior area 4 of the gripping element 2.

To reach the primary door opening position A, a user pulls on the gripping element 2 from its rest position to the primary door opening position A, allowing to send an electrical opening door leaf signal.

Deploying the gripping element 2 mechanically by pushing the gripping element 2 in an opening mechanical zone, leading the gripping element 2 to the rest position, in case of a flush handle 1, is also possible.

If the door leaf handle 1 is a non-flush handle, when the gripping element is in the rest position, the user pulls directly on the gripping element 2 from its rest position to the primary door opening position A to open the door leaf.

In case of a crash of the motor vehicle or if the vehicle battery is depleted, the door leaf is blocked. Indeed, in some of cases, the electrical system of the vehicle is down and especially the primary door opening mechanism.

Therefore, a person located outside the vehicle cannot open the door using the primary door mechanism. To open the door leaf from the exterior of the vehicle, for example by a policeman or a fireman to help the occupant, the rescuer must pull the gripping element 2 from the primary door opening position A with a predetermined force. In one configuration, the predetermined force is of the order of seven hundred Newtons.

This pulling with the predetermined force allows breaking the breakable stops 6 because of the pressure exerted on the bracket 3. In fact, the breakable area 20, 22 of each breakable stop 6 are broken, separating the breakable area 20, 22 from the non-breakable area 21, 23 and allowing a bigger stroke of the gripping element 2.

Indeed, the gripping element 2 can then be displaced from the primary door opening position A to the secondary door opening position B using the secondary door opening mechanism 24, by pulling the Bowden cable 14 or the rod bonding to the gripping element 2 by the first fixed part 16 and the second fixed part 18 and passing around the pulley, allowing the opening of the door leaf of the motor vehicle.

When a person pulls the gripping element 2 from the primary door opening position A to the secondary door opening position B, the pin 19 drives the lever 12 from the inactive position C to the active position D. The distance between the inactive position C and the active position D is of the order of E.

This allows pulling on the Bowden cable 14 or the rod at the level of its second extremity 17 that is connected to the latch.

The distance traveled by the second extremity 17 is of the order of 2E.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A door leaf handle for a motor vehicle comprising:

a bracket;

a gripping element movable relative to the bracket between a rest position, a primary door opening position and a secondary door opening position;

at least one breakable stop configured to limit the displacement of the gripping element in the primary door opening position if a pulling force applied on the gripping element is less than a predetermined force value, and configured to break if a pulling force applied on the gripping element exceeds the predetermined force value and to allow the mechanical displacement of the gripping element beyond the primary door opening position to the secondary door opening position;

a primary door opening trigger configured to be activated by the displacement of the gripping element in the primary door opening position;

a secondary mechanical door opening trigger configured to be activated by the displacement of the gripping element in the secondary door opening position, wherein the at least one breakable stop is a part of the gripping element such that there is no relative movement therebetween when the gripping element moves between the rest position and the primary door opening position, and wherein the gripping element comprises an exterior area turned toward the vehicle exterior and an interior area turned toward the vehicle interior, the at least one breakable stop being arranged on the interior area of the gripping element.

2. The door leaf handle according to claim 1, wherein the primary door opening mechanism is an electrical mechanism activated by an actuator configured to send an electrical door leaf opening signal.

3. The door leaf handle according to claim 1, wherein the at least one breakable stop is arranged against the bracket.

4. The door leaf handle according to claim 1, wherein the gripping element is movable in rotation relative to the bracket according to a rotation axis of the gripping element perpendicular to the gripping element deployment, the at least one breakable stop extending radially to the bracket.

5. The door leaf handle according to claim 1, wherein the at least one breakable stop is integral with the gripping element.

6. The door leaf handle according to claim 1, wherein the at least one breakable stop is inserted or overmolded with the gripping element.

7. The door leaf handle according to claim 6, wherein the at least one breakable stop is wrapped with a seal.

8. The door leaf handle according to claim 1, wherein the at least one breakable stop comprises a breakable area, and a non-breakable area, the breakable area and the non-breakable area being delimited by a breaking point configured to separate the breakable area from the non-breakable area when a predetermined force is exerted on the gripping element.

9. An assembly comprising a door leaf handle according to claim 1 and further comprising a latch, a primary door opening mechanism coupled with the primary door opening trigger, and a secondary door opening mechanism coupled with the secondary door opening trigger.

10. The assembly according to claim 9, wherein the secondary door opening mechanism comprises a Bowden cable or a rod.

11. The assembly according to claim 10, wherein the secondary door opening mechanism is configured to generate a displacement of the Bowden cable or the rod, wherein a value of the displacement is a multiple of a gripping element displacement.

12. The assembly according to claim 10, wherein the secondary door opening mechanism comprises a lever comprising a pulley, wherein the Bowden cable or the rod is configured to wrap around the pulley.

13. The assembly according to claim 10, wherein the Bowden cable or the rod comprises a first extremity connected to a first fixed part and a second extremity connected to the latch.

14. The assembly according to claim 12, wherein a pin attached to the gripping element is configured to drive the lever from an inactive position to an active position, wherein the driving is performed when the gripping element is moved from the primary door opening position to the secondary door opening position.

* * * * *